United States Patent [19]

Katzy et al.

[11] Patent Number: 5,070,967

[45] Date of Patent: Dec. 10, 1991

[54] SYSTEM FOR MONITORING THE OPERATION OF A CAGE MOVING IN A MINE SHAFT

[75] Inventors: Klaus Katzy, Pierrefonds; Bruno Leijon, Point Claire; Damir Kudeljan, Pierrefonds, all of Canada

[73] Assignee: Asea Brown Boveri Inc., Quebec, Canada

[21] Appl. No.: 603,527

[22] Filed: Oct. 25, 1990

[30] Foreign Application Priority Data

Nov. 7, 1989 [CA] Canada ..... 2,002,409

[51] Int. Cl.[5] ..... B66B 1/28

[52] U.S. Cl. ..... 187/116; 187/134

[58] Field of Search ..... 187/105, 133, 122, 116, 187/134

[56] References Cited

U.S. PATENT DOCUMENTS

| | | | |
|---|---|---|---|
| 3,889,231 | 6/1975 | Tosato et al. | 187/134 |
| 3,973,648 | 8/1976 | Hummert et al. | 187/133 |
| 4,096,925 | 6/1978 | Koob et al. | 187/134 |
| 4,387,436 | 6/1983 | Katayama et al. | 187/134 |
| 4,527,662 | 7/1985 | Doane et al. | 187/116 |
| 4,658,935 | 4/1987 | Holland | 187/122 |
| 4,671,391 | 6/1987 | Sasao | 187/134 |
| 4,716,517 | 12/1987 | Iwata | 187/134 |
| 4,930,604 | 6/1990 | Schienda et al. | 187/133 |
| 4,982,815 | 1/1991 | Arabori et al. | 187/105 |

OTHER PUBLICATIONS

"Automated Hoists Britain, Post-Markham", by Roger Davies, published in World Mining Equipment, Mar. 1989, pp. 29–36.

ABB Drives, "Microcomputer Based Hoist Monitor British Coal", Harworth No. 1 (1989) pp. 1 to 13.

*Primary Examiner*—A. D. Pellinen
*Assistant Examiner*—L. Colbert
*Attorney, Agent, or Firm*—Fishman, Dionne & Cantor

[57] ABSTRACT

A pulse encoder digitally derives a first value of speed at which the cage is moving at any given time. An analog device, such as a tachogenerator, derives the second value of the speed, in analog form, at which the cage is moving at the same time. The two speeds are compared in a comparator to determine the differences therebetween. If the difference exceeds a predetermined limit, an emergency stop is tripped to arrest the motion of the cage.

17 Claims, 2 Drawing Sheets

SYSTEM FOR MONITORING THE OPERATION OF A CAGE MOVING IN A MINE SHAFT

BACKGROUND OF INVENTION

1. Field of the Invention

The invention relates to a system for monitoring the operation of cages moving in mine shafts. More specifically, the invention relates to such a system for monitoring the speed of cages moving in such mine shafts wherein said speed is detected using digital means and analog backup means, and the digitally derived speed value is compared with the analog derived speed value to determine if the digital means are operating correctly.

2. Description of Prior Art

The first hoist controllers were mechanical and were referred to .as the so-called Lily controllers. These had the problems of backlash, being difficult to adjust, and not being easy to test. In addition, if any element failed, then the entire system would fail as described by Roger Davies in *Automated Hoists Britain, Post-Markham*, published in World Mining Equipment, March 1989, at pages 29 to 36.

Accordingly, the mechanical systems were replaced by electronic systems, and examples of electronic systems are described in the Davies article. Basically, the electronic systems consisted of toothed wheels and pulsers which would sense the passing of the toothed wheels and provide output pulses each time a toothed wheel passed the pulsor. The toothed wheel could be connected to the shaft of the drum of the hoist system so that the pulsers would have indications of the position of the cage in the mining shaft. The position signal as determined by the pulsers was compared with a position signal as determined by proximity switches in the shaft (see FIG. 2 of the article) or by the position signal as determined by pulses from magnetized rope (see FIG. 4 of the article). Both the proximity switches and the magnetized rope systems are expensive and not very reliable.

SUMMARY OF INVENTION

It is therefore an object of the invention to provide a system for monitoring the operation of a cage moving in a mining shaft which overcomes the disadvantages of the prior art.

It is a further object of the invention to provide such a system which is relatively inexpensive but relatively more reliable than the systems of the prior art.

In accordance with the invention, there is provided a digital electronic system for determining the position and speed of a cage in a mining shaft. The speed is also determined by an analog means, and the speed as derived digitally is compared with the speed of analog derivation. If the difference between the two derived speeds exceeds a predetermined limit, then the motion of the cage is arrested.

In accordance with a particular embodiment there is provided a system for monitoring the operation of a cage moving in a mine shaft, comprising:

digital means for digitally deriving a first value of the speed at which said cage is moving at a given time;

analog means for analog derivation of a second value of the speed at which said cage is moving at said given time;

comparator means for comparing said first value with said second value to determine the difference therebetween;

wherein, if said difference exceeds a predetermined limit, an emergency stop is tripped to arrest the motion of said cage.

BRIEF DESCRIPTION OF DRAWINGS

The invention will be better understood by an examination of the following description, together with the accompanying drawings, in which.

DESCRIPTION OF PREFERRED EMBODIMENTS

Figure 1:
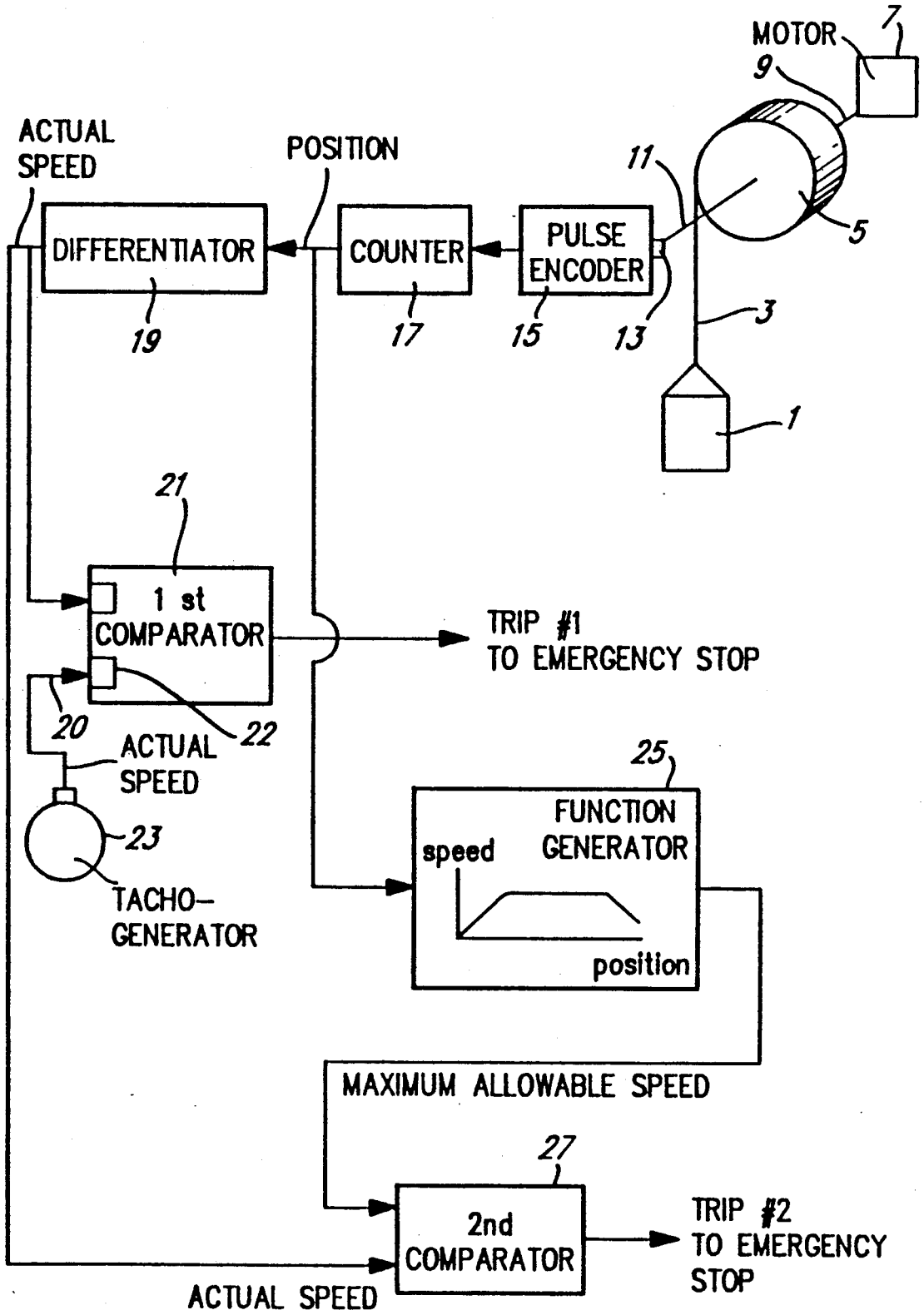
FIG. 1 is a block diagram of a system in accordance with the invention.

Turning to FIG. 1, a cage 1, which will move up and down in a mining shaft, is suspended by a winding rope 3 which can be wound onto or unwound from a drum 5. The drum 5 is driven by a motor 7 through motor shaft 9. Drum shaft 11, in one embodiment, is connected to an input shaft 13 of pulse encoder 15.

The output of pulse encoder 15 is fed to the input of counter 17, and the output of counter 17 is fed to the input of differentiator 19. The output of differentiator 19 is fed to first comparator 21 whose second input is fed from an analog means for speed determination, for example, tachogenerator 23.

The output of counter 17 is also fed to the input of function generator 25 whose output is fed to one input terminal of second comparator 27. The second input terminal of the second comparator 27 is connected to the output of differentiator 19.

In operation, the input shaft of the pulse encoder 15 rotates with shaft 11 of the drum 5. As the length of winding rope 3 which is unwound from, or wound onto drum 5 is a function of the number of rotations of drum 5, the output of the pulse encoder 15 will be indicative of the position of the cage in the mining shaft. The signal at the output of the pulse encoder 15 is counted in the counter 17 to provide a count representative of the position of the cage.

In the differentiator 19, the cage positions at the beginning and end of a predetermined time interval are measured, and the speed for that time interval is determined by dividing the distance travelled by the time interval. This gives the actual speed of the cage as digitally derived.

The tachogenerator, or other analog means, 23 provides an analog derivation of the speed of the cage. The analog signal at the output of the tachogenerator is converted to a digital signal by digital-to-analog converter 22. The two digital signals are then compared in first comparator 21. Obviously, the digital signal from 19 could be converted to an analog signal and then compared to the analog output of the tachogenerator 23.

If both the digital and analog systems are working correctly, then the two measured speeds should be substantially the same. Accordingly, if the output of the first comparator 21 exceeds a predetermined limit, then it will trip an emergency stop to arrest the motion of the cage.

The predetermined limit could be, for example, 10% of the maximum speed.

As is well known, it is necessary that the speed of the cage in the shaft be functionally related to its position in the shaft. Thus, as illustrated in block 25 in FIG. 1, as the cage approaches the ends of the shaft, it must slow down. In order to determine that the actual speed of the cage does not exceed the maximum allowable speed at each position in the cage, the function generator generates a function such as the function illustrated in the block 25 in FIG. 1. Accordingly, when a position is fed to the input of the function generator 25, the output provides a signal representative of the maximum allowable speed at that position. This is then compared, in the second comparator 27, with the actual speed as digitally derived in the differentiator 19. If the actual speed exceeds the maximum allowable, then an emergency stop is once again tripped to arrest the motion of the cage.

Figure 2:
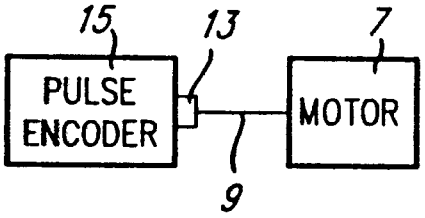
FIG. 2 illustrates how the pulse encoder can be driven by the motor shaft.
Figure 3:
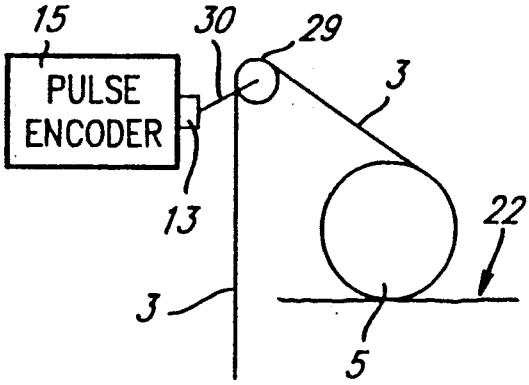
FIG. 3 illustrates how the pulse encoder can be driven by a sheve wheel.

Although in FIG. 1 the input shaft 13 of the pulse encoder is illustrated as being attached to the shaft 11 of the drum 5, as illustrated in FIG. 2, it is equally feasible that the input shaft 13 of the shaft encoder 15 be connected to the shaft 9 of the motor 7. In the situation when the drum 5 is mounted at ground level, the winding rope 3 is directed upwardly to a sheve wheel 29 having a shaft 30. It is also possible to connect the input shaft 13 of the pulse encoder 15 to the shaft 30 of the sheve wheel 29.

Figure 4:
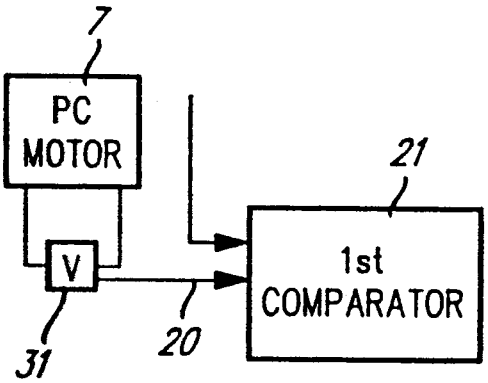
FIG. 4 illustrates an alternate means for analog speed derivation.
Figure 5:
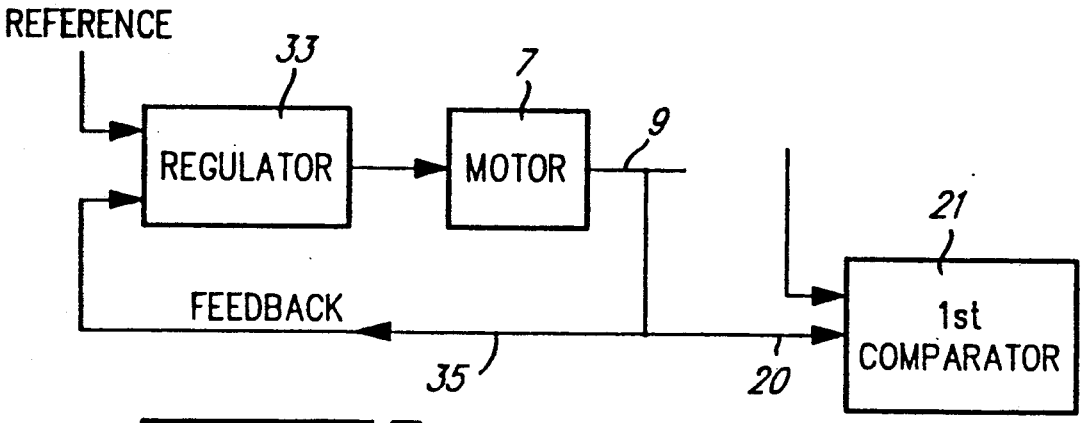
FIG. 5 a still further alternate means for analog speed derivation.

Although FIG. 1 illustrates the analog means for deriving speed as being a tachogenerator, as shown in FIG. 4, when the motor 7 comprises a DC motor, it is possible to use the armature voltage as the analog signal. For this purpose, a voltage transducer or the like 31 is placed across the armature, and the output of the volt meter is fed to the first comparator 21 in place of the tachogenerator output. Alternatively, as seen in FIG. 5, when there is a speed regulator 33 for regulating the speed of the motor 7, and the regulator arrangement includes a feedback circuit 35, then the feedback can be used as the analog signal and fed to terminal 20 of the first comparator instead of the output of the tachogenerator.

Although the Figures have illustrated separate hardware components for different functions, for example, a counter, differentiator, comparators, and function generator, it will be obvious to one skilled in the art that all of these hardware function elements can be replaced by an appropriately programmed microprocessor. Accordingly, it is within the scope of the invention to use only the pulse encoder and analog speed determining means of FIG. 1 in association with a microprocessor. The output of the pulse encoder and the analog speed determining means would be fed to appropriate terminals of an appropriately programmed microprocessor.

The inventive system has the advantage of providing greater accuracy of operation. The function of the function generator can be easily programmed, especially when using a microprocessor, so that the peculiar shapes required for each mining shaft, and for specific hoist applications, can be programmed into the function generator so that the system is, in effect, tailor-made.

Position determination with the inventive system is in the range of fractions of an inch compared to much greater values of the electro-mechanical devices due to play in the mechanical drive. Amongst others, this permits much better accuracy in overwind settings.

The inventive system is also safe, reliable and can easily perform a test. Thus, by pressing a test button in an appropriately modified system, both ends of the shaft are "shortened" to a preprogrammed value, for example, 300 feet. Approaching the "shortened" shaft with any test speed results in tripping the emergency stop, and the stop position related to the shortened shaft end indicates the distance from the real shaft end should the conveyance approach that end without slowing down. Obviously, this test would be conducted in mid shaft. During the test, the efficiency of the protection as well as of the breaking system can be reliably determined.

Self-checking features, such as comparison of the cage speed signal with signals from independent sources, cross-checking of the position signal with independent outside signals, etc. can be implemented with this system. In addition, the new shaft depth can be easily programmed by reprogramming the function generator.

It will also, of course, be possible to use one or more digital displays connected to the system. The displays can display such values as: conveyance cage position in the shaft, distance of the cage from the shaft end, speed, speed safety margin (difference between actual speed and maximum allowable speed), breaking distance during emergency breaking tests, acceleration/deceleration values, etc. In addition, the choice of signals to be displayed can be made either during setting up of the system or for any particular application in an appropriately modified system.

It is accordingly seen that a system which has advantages relative to the prior art is provided in accordance with the invention.

Although several embodiments have been described, this was for the purpose of illustrating, but not limiting, the invention. Various modifications, which will come readily to the mind of one skilled in the art, are within the scope of the invention as defined in the appended claims.

We claim:

1. A system for monitoring the operation of a cage moving in a mine shaft, comprising:

digital means for digitally deriving a first value of the speed at which said cage is moving at a given time;

analog means for analog derivation of a second value of the speed at which said cage is moving at said given time;

comparator means for comparing said first value with said second value to determine the difference therebetween;

wherein, if said difference exceeds a predetermined limit, an emergency stop is tripped to arrest the motion of said cage.

2. A system as defined in claim 1 wherein said cage is suspended by a winding rope which can be wound onto or unwound from a drum whereby to move the cage up or down in said mine shaft;

said digital means comprising pulse encoder means having an output;

wherein, the count at the output of said pulse encoder means in a time interval is directly related to the length of rope which is unwound from said drum or wound onto said drum in said time interval;

whereby, to determine the position of said cage in said shaft during said time interval.

3. A system as defined in claim 2 and further comprising a counter having an input and an output;
the output of said pulse encoder means being connected to the input of said counter;
the signal at the output of said counter being representative of the position of said cage in said shaft.

4. A system as defined in claim 3 and further comprising a differentiator having an input and an output, and said comparator means comprising a comparator having a first input, a second input and an output;
said analog means having an output;
the output of said counter being connected to the input of said differentiator;
the output of said differentiator being connected to the first input of said comparator;
the output of said analog means being connected to the second input of said comparator;
the output of said comparator being connected to trip means for arresting the motion of said cage when the output of said comparator exceeds a predetermined limit.

5. A system as defined in claim 4 and further comprising a function generator means, having an input and an output, for generating a function of maximum speed allowable at each position of the cage in said shaft;
a second comparator having a first input, a second input and an output;
said output of said counter being connected to said input of said function generator;
said output of said function generator being connected to said first input of said second comparator;
said output of said differentiator being connected to said second input of said second comparator;
whereby, to compare the actual speed of said cage in said shaft at each position in said shaft with the maximum allowable speed of said cage in said shaft at corresponding positions in said shaft;
the output of said second comparator being connected to second trip means;
whereby, if the actual speed of said cage in said shaft exceeds the maximum allowable speed of said cage in said shaft at any position in said shaft, said trip means will arrest the motion of said cage.

6. A system as defined in claim 5 wherein said analog means comprises a tachogenerator.

7. A system as defined in claim 6 and further including a drum driving motor having a motor shaft, said drum having a drum shaft, said motor shaft being connected to said drum for rotatingly driving said drum;
said pulse encoder having an input shaft;
said input shaft of said pulse encoder being connected to said motor shaft.

8. A system as defined in claim 6 and further including a drum driving motor having a motor shaft, said drum having a drum shaft, said motor shaft being connected to said drum for rotatingly driving said drum;
said pulse encoder having an input shaft;
said shaft of said pulse encoder being connected to said drum shaft.

9. A system as defined in claim 6 wherein said drum is mounted at ground level;
said winding rope being directed upwardly to a sheve wheel and downwardly from said sheve wheel;
said sheve wheel including a shaft;
said pulse encoder having an input shaft;
said input shaft of said pulse encoder being connected to said shaft of said sheve wheel.

10. A system as defined in claim 5 and further including a speed regulator for regulating the speed of said drum and having a speed feedback means;
said analog means comprising means for measuring the signal of said speed feedback means.

11. A system as defined in claim 10 and further including a drum driving motor having a motor shaft, said drum having a drum shaft, said motor shaft being connected to said drum for rotatingly driving said drum;
said pulse encoder having an input shaft;
said input shaft of said pulse encoder being connected to said motor shaft.

12. A system as defined in claim 10 and further including a drum driving motor having a motor shaft, said drum having a drum shaft, said motor shaft being connected to said drum for rotatingly driving said drum;
said pulse encoder having an input shaft;
said shaft of said pulse encoder being connected to said drum shaft.

13. A system as defined in claim 10 wherein said drum is mounted at ground level;
said winding rope being directed upwardly to a sheve wheel and downwardly from said sheve wheel;
said sheve wheel including a shaft;
said pulse encoder having an input shaft;
said input shaft of said pulse encoder being connected to said shaft of said sheve wheel.

14. A system as defined in claim 5 and further including a drum driving DC motor having a motor shaft, said drum having a drum shaft, said motor shaft being connected to said drum for rotatingly driving said drum;
said DC motor having an armature;
said analog means comprising means for measuring the armature voltage.

15. A system as defined in claim 14 wherein said pulse encoder has an input shaft;
said input shaft of said pulse encoder being connected to said motor shaft.

16. A system as defined in claim 14 wherein said pulse encoder has an input shaft;
said input shaft of said pulse encoder being connected to said drum shaft.

17. A system as defined in claim 14 wherein said drum is mounted at ground level;
said winding rope being directed upwardly to a sheve wheel and downwardly from said sheve wheel;
said sheve wheel including a shaft;
said pulse encoder having an input shaft;
said input shaft of said pulse encoder being connected to said shaft of said sheve wheel.

* * * * *